US006906681B2

(12) United States Patent
Hoppenstein

(10) Patent No.: US 6,906,681 B2
(45) Date of Patent: Jun. 14, 2005

(54) MULTICARRIER DISTRIBUTED ACTIVE ANTENNA

(75) Inventor: Russell Hoppenstein, Richardson, TX (US)

(73) Assignee: Andrew Corporation, Orland Park, IL (US)

( * ) Notice: Subject to any disclaimer, the term of this patent is extended or adjusted under 35 U.S.C. 154(b) by 307 days.

(21) Appl. No.: 10/256,947

(22) Filed: Sep. 27, 2002

(65) Prior Publication Data

US 2004/0066352 A1 Apr. 8, 2004

(51) Int. Cl.[7] ..... H01Q 21/00
(52) U.S. Cl. ..... 343/853; 342/375
(58) Field of Search ..... 343/853, 810; 342/373, 374, 375; 455/91, 101, 103, 104, 562

(56) References Cited

U.S. PATENT DOCUMENTS

| | | | | |
|---|---|---|---|---|
| 4,070,637 A | | 1/1978 | Assal et al. | 333/7 R |
| 4,124,852 A | | 11/1978 | Steudel | 343/854 |
| 4,246,585 A | | 1/1981 | Mailloux | 343/854 |
| 4,360,813 A | | 11/1982 | Fitzsimmons | 343/100 R |
| 4,566,013 A | | 1/1986 | Steinberg et al. | 343/372 |
| 4,607,389 A | | 8/1986 | Halgrimson | 455/11 |
| 4,614,947 A | | 9/1986 | Rammos | 343/778 |
| 4,689,631 A | | 8/1987 | Gans et al. | 343/781 R |
| 4,825,172 A | | 4/1989 | Thompson | 330/124 R |
| 4,849,763 A | | 7/1989 | DuFort | 342/372 |
| 4,890,110 A | | 12/1989 | Kuwahara | 342/35 |
| 4,994,813 A | | 2/1991 | Shiramatsu et al. | 342/360 |
| 5,034,752 A | | 7/1991 | Pourailly et al. | 342/373 |
| 5,038,150 A | | 8/1991 | Bains | 342/373 |
| 5,061,939 A | | 10/1991 | Nakase | 343/700 MS |
| 5,163,181 A | * | 11/1992 | Koontz | 455/103 |
| 5,206,604 A | | 4/1993 | Vaninetti | 330/124 R |
| 5,230,080 A | | 7/1993 | Fabre et al. | 455/15 |
| 5,247,310 A | | 9/1993 | Waters | 342/368 |
| 5,248,980 A | | 9/1993 | Raguenet | 342/354 |
| 5,270,721 A | | 12/1993 | Tsukamoto et al. | 343/700 MS |
| 5,280,297 A | | 1/1994 | Profera, Jr. | 343/754 |
| 5,327,150 A | | 7/1994 | Cherrette | 343/771 |
| 5,355,143 A | | 10/1994 | Zurcher et al. | 343/700 MS |
| RE34,796 E | | 11/1994 | Smith et al. | 343/876 |
| 5,379,455 A | | 1/1995 | Koschek | 455/273 |
| 5,412,414 A | | 5/1995 | Ast et al. | 342/174 |
| 5,437,052 A | | 7/1995 | Hemmie et al. | 455/5.1 |
| 5,457,557 A | | 10/1995 | Zarem et al. | 359/121 |
| 5,513,176 A | | 4/1996 | Dean et al. | 370/18 |
| 5,548,813 A | | 8/1996 | Charas et al. | 455/33.3 |
| 5,554,865 A | | 9/1996 | Larson | 257/275 |
| 5,568,160 A | | 10/1996 | Collins | 343/778 |

(Continued)

FOREIGN PATENT DOCUMENTS

| | | | |
|---|---|---|---|
| CA | 2306650 | 10/2000 | H01Q/21/06 |
| EP | 0 245 955 A2 | 11/1987 | H03F/1/32 |
| EP | 0 447 218 B1 | 9/1991 | H01Q/5/00 |

(Continued)

OTHER PUBLICATIONS

Howat, F., "Cell Like Performance Using the Remotely Controlled Cellular Transmitter", *Gateway to New Concepts in Vehicular Technology,* San Francisco, CA, May 1–3, 1989, Vehicular Technology Conference, 39th IEEE, vol. 2, pp. 535–541, XP000076080.

(Continued)

*Primary Examiner*—Tan Ho
(74) *Attorney, Agent, or Firm*—Wood, Herron & Evans, LLP

(57) ABSTRACT

A distributed active antenna includes a power module having a parallel combination of power amplifiers for driving each antenna element of the distributed active antenna. A predistortion linearization circuit may be coupled to each power module to linearize the output of each antenna element of the distributed active antenna.

25 Claims, 3 Drawing Sheets

U.S. PATENT DOCUMENTS

| | | | | |
|---|---|---|---|---|
| 5,596,329 | A | 1/1997 | Searle et al. | 342/374 |
| 5,604,462 | A | 2/1997 | Gans et al. | 330/124 R |
| 5,604,925 | A | 2/1997 | O'Malley et al. | 455/254 |
| 5,610,510 | A | 3/1997 | Boone et al. | 324/95 |
| 5,619,210 | A | 4/1997 | Dent | 342/352 |
| 5,623,269 | A | 4/1997 | Hirshfield et al. | 342/354 |
| 5,644,316 | A | 7/1997 | Lewis et al. | 342/174 |
| 5,644,622 | A | 7/1997 | Russell et al. | 455/422 |
| 5,646,631 | A | 7/1997 | Arntz | 342/373 |
| 5,657,374 | A | 8/1997 | Russell et al. | 370/328 |
| 5,659,322 | A | 8/1997 | Caille | 342/188 |
| 5,680,142 | A | 10/1997 | Smith et al. | 342/372 |
| 5,710,804 | A | 1/1998 | Bhame et al. | 379/58 |
| 5,714,957 | A | 2/1998 | Searle et al. | 342/374 |
| 5,724,666 | A | 3/1998 | Dent | 455/562 |
| 5,745,841 | A | 4/1998 | Reudink et al. | 455/62 |
| 5,751,250 | A | 5/1998 | Arntz | 342/373 |
| 5,754,139 | A | 5/1998 | Turcotte et al. | 342/373 |
| 5,758,287 | A | 5/1998 | Lee et al. | 455/450 |
| 5,770,970 | A | 6/1998 | Ikeda et al. | 330/286 |
| 5,771,017 | A | 6/1998 | Dean et al. | 342/374 |
| 5,774,666 | A | 6/1998 | Portuesi | 395/200.48 |
| 5,784,031 | A | 7/1998 | Weiss et al. | 342/373 |
| 5,790,078 | A | 8/1998 | Suzuki et al. | 343/700 MS |
| 5,815,115 | A | 8/1998 | Cartoni et al. | 342/359 |
| 5,802,173 | A | 9/1998 | Hamilton-Piercy et al. | 379/56.2 |
| 5,809,395 | A | 9/1998 | Hamilton-Piercy et al. | 455/4.1 |
| 5,825,762 | A | 10/1998 | Kamin, Jr. et al. | 370/385 |
| 5,832,389 | A | 11/1998 | Dent | 455/562 |
| 5,835,128 | A | 11/1998 | Macdonald et al. | 348/8 |
| 5,854,611 | A | 12/1998 | Gans et al. | 342/373 |
| 5,856,804 | A | 1/1999 | Turcotte et al. | 342/371 |
| 5,862,459 | A | 1/1999 | Charas | 455/114 |
| 5,872,547 | A | 2/1999 | Martek | 343/815 |
| 5,878,345 | A | 3/1999 | Ray et al. | 455/431 |
| 5,880,701 | A | 3/1999 | Bhame et al. | 343/890 |
| 5,884,147 | A | 3/1999 | Reudink et al. | 455/67.1 |
| 5,889,494 | A | 3/1999 | Reudink et al. | 342/373 |
| 5,896,104 | A | 4/1999 | Komatsu et al. | 342/175 |
| 5,929,823 | A | 7/1999 | Martek et al. | 343/817 |
| 5,933,113 | A | 8/1999 | Newberg et al. | 342/375 |
| 5,936,577 | A | 8/1999 | Shoki et al. | 342/373 |
| 5,936,591 | A | 8/1999 | Yamasa et al. | 343/853 |
| 5,940,045 | A | 8/1999 | Belcher et al. | 343/850 |
| 5,949,376 | A | 9/1999 | McDonald et al. | 343/700 MS |
| 5,966,094 | A | 10/1999 | Ward et al. | 342/373 |
| 5,969,689 | A | 10/1999 | Martek et al. | 343/758 |
| 5,987,335 | A | 11/1999 | Knoedl, Jr. et al. | 455/561 |
| 6,008,763 | A | 12/1999 | Nystrom et al. | 343/700 MS |
| 6,016,123 | A | 1/2000 | Barton et al. | 342/373 |
| 6,018,643 | A | 1/2000 | Golemon et al. | 455/63 |
| 6,020,848 | A | 2/2000 | Wallace et al. | 342/362 |
| 6,037,903 | A | 3/2000 | Lange et al. | 343/700 MS |
| 6,043,790 | A | 3/2000 | Derneryd et al. | 343/853 |
| 6,047,199 | A | 4/2000 | DeMarco | 455/572 |
| 6,055,230 | A | 4/2000 | Feuerstein et al. | 370/335 |
| 6,070,090 | A | 5/2000 | Feuerstein | 455/561 |
| 6,072,434 | A | 6/2000 | Papatheodorou | 343/700 MS |
| 6,091,360 | A | 7/2000 | Reits | 342/368 |
| 6,094,165 | A | 7/2000 | Smith | 342/373 |
| 6,104,935 | A | 8/2000 | Smith et al. | 455/562 |
| 6,140,976 | A | 10/2000 | Locke et al. | 343/853 |
| 6,144,652 | A | 11/2000 | Avidor et al. | 370/336 |
| 6,157,343 | A | 12/2000 | Andersson et al. | 342/371 |
| 6,160,514 | A | 12/2000 | Judd | 343/700 MS |
| 6,181,276 | B1 | 1/2001 | Schlekewey et al. | 342/372 |
| 6,188,373 | B1 | 2/2001 | Martek | 343/893 |
| 6,195,556 | B1 | 2/2001 | Reudink et al. | 455/456 |
| 6,198,434 | B1 | 3/2001 | Martek et al. | 342/373 |
| 6,198,435 | B1 | 3/2001 | Reudink et al. | 342/373 |
| 6,198,460 | B1 | 3/2001 | Brankovic | 343/879 |
| 6,222,503 | B1 | 4/2001 | Gietema et al. | 343/890 |
| 6,233,434 | B1 | 5/2001 | Takei | 455/103 |
| 6,233,466 | B1 | 5/2001 | Wong et al. | 455/562 |
| 6,236,849 | B1 | 5/2001 | Reudink et al. | 455/342 |
| 6,240,274 | B1 | 5/2001 | Izadpanah | 455/39 |
| 6,246,674 | B1 | 6/2001 | Feuerstein et al. | 370/334 |
| 6,266,545 | B1 | 7/2001 | Backman et al. | 455/572 |
| 6,269,255 | B1 | 7/2001 | Waylett | 455/562 |
| 6,377,558 | B1 | 4/2002 | Dent | 370/321 |
| 6,519,478 | B1 | 2/2003 | Scherzer et al. | 455/562 |
| 6,529,715 | B1 * | 3/2003 | Kitko et al. | 455/103 |
| 6,646,504 | B2 * | 11/2003 | Dittmer et al. | 330/124 R |

FOREIGN PATENT DOCUMENTS

| | | | | |
|---|---|---|---|---|
| EP | 0 551 556 | A1 | 7/1993 | H01P/5/08 |
| EP | 0 639 035 | A1 | 2/1995 | H04Q/7/36 |
| EP | 0 713 261 | A1 | 5/1996 | H01Q/3/26 |
| EP | 0 878 974 | A1 | 11/1998 | H04Q/7/22 |
| EP | 0 984 554 | A2 | 3/2000 | H03F/1/32 |
| EP | 0 994 567 | A2 | 4/2000 | H04B/1/00 |
| EP | 1 111 821 | A2 | 6/2001 | H04B/17/00 |
| GB | 2 286 749 | A | 8/1995 | H04B/7/08 |
| GB | 2 320 618 | A | 6/1998 | H04Q/7/36 |
| JP | 08-102168 | | 4/1996 | H01Q/25/00 |
| JP | 11-330838 | | 11/1999 | H01Q/3/26 |
| WO | WO 95/26116 | | 9/1995 | H04Q/7/36 |
| WO | WO 95/34102 | | 12/1995 | H01Q/1/38 |
| WO | WO 97/44914 | | 11/1997 | H04B/1/50 |
| WO | WO 98/11626 | | 3/1998 | H01Q/23/00 |
| WO | WO 98/39851 | | 9/1998 | H04B/1/38 |
| WO | WO 98/09372 | | 1/1999 | H04B/1/04 |
| WO | WO 99/26317 | | 5/1999 | H01Q/21/30 |
| WO | WO 00/03479 | | 1/2000 | H03F/3/21 |
| WO | WO 00/31824 | | 6/2000 | H01Q/5/00 |
| WO | WO 00/39943 | | 7/2000 | H04B/7/04 |
| WO | WO 01/06801 | A1 | 1/2001 | H04Q/7/30 |
| WO | WO 98/50981 | | 4/2001 | H01Q/3/26 |
| WO | WO 02/19470 | A1 | 3/2002 | H01Q/23/00 |
| WO | WO 02/039541 | A3 | 5/2002 | H01Q/1/24 |

OTHER PUBLICATIONS

Shibutani, Makoto et al., "Optical Fiber Feeder for Microcellular Mobile Communication Systems (H–015)", *IEEE Journal on Selected Areas in Communications,* IEEE Inc., New York, NY, vol. 11, No. 7, Sep. 1993, pp. 1118–1126, XP000400021, ISSN: 0733–8716.

U.S. Appl. No. US 2002/0008577 A1, filed Jan. 24, 2002, Cova et al., *High Linearity Multicarrier RF Amplifier,* (13 pages).

Song, H.J. and Bialkowski, M.E., *A Multilayer Microstrip Patch Antenna Subarray Design Using CAD,* Microwave Journal, Mar. 1997, pp. 22–34 (8 pages).

Levine, E., Malamud, G., Shtrikman, S., and Treves, D., *A study Microstrip Array Antennas with the Feed Network,* IEEE Trans. Antennas Propagation, vol. 37, No. 4, Apr. 1989, pp. 426–434 (8 pages).

Herd, J.S., *Modelling of Wideband Proximity Coupled Microstrip Array Elements,* Electronic Letters, vol. 2, No. 16, Aug. 1990, pp. 1282–1284 (3 pages).

Hall, P.S., and Hall, C.M., *Coplanar Corporate Feed Effects in Microstrip Patch Array Design,* Proc. IEEE, vol. 135, pt. H, Jun. 1988, p. 180–186 (7 pages).

Zurcher, J.F., *The SSFIP: A Global Concept for High–Performance Broadband Planar Antennas,* Electronic Letters, vol. 24, No. 23, Nov. 1988, p. 1433–1435 (4 pages).

Zurcher, J.F. and Gardiol, F.E., *The SSFIP Principle: Broadband Patch Antennas,* Artech House, 1995, Chapter 3, pp. 45–60 (17 pages).

Song, H.J. and Blalkowski, M.E., *Ku–Band 16 x 16 Planar Array with Aperture–Coupled Microstrip–Patch Elements,* IEEE Antennas and Propagation Magazine, vol. 40, No. 5, Oct. 1998, pp. 25–29 (5 pages).

* cited by examiner

MULTICARRIER DISTRIBUTED ACTIVE ANTENNA

FIELD OF THE INVENTION

The present invention relates generally to antenna systems used in the provision of wireless communication services and, more particularly, to an active antenna array adapted to be mounted on a tower or other support structure for providing wireless communication services.

BACKGROUND OF THE INVENTION

Wireless communication systems are widely used to provide voice and data communication between multiple mobile stations or units, or between mobile units and stationary customer equipment. In a typical wireless communication system, such as a cellular system, one or more mobile stations or units communicate with a network of base stations linked at a telephone switching office. In the provision of cellular services within a cellular network, individual geographic areas or "cells" are serviced by one or more of the base stations. A typical base station includes a base station control unit and an antenna tower (not shown). The control unit comprises the base station electronics and is usually positioned within a ruggedized enclosure at, or near, the base of the tower. The control unit is coupled to the switching office through land lines or, alternatively, the signals might be transmitted or backhauled through backhaul antennas. A typical cellular network may comprise hundreds of base stations, thousands of mobile stations or units and one or more switching offices.

The switching office is the central coordinating element of the overall cellular network. It typically includes a cellular processor, a cellular switch and also provides the interface to the public switched telephone network (PSTN). Through the cellular network, a duplex radio communication link may be established between users of the cellular network.

In one typical arrangement of a base station, one or more passive antennas are supported at the tower top or on the tower and are oriented about the tower to define the desired beam sectors for the cell. A base station will typically have three or more RF antennas and possibly one or more microwave backhaul antennas associated with each wireless service provider using the base station. The passive RF antennas are coupled to the base station control unit through multiple RF coaxial cables that extend up the tower and provide transmission lines for the RF signals communicated between the passive RF antennas and the control unit during transmit ("down-link") and receive ("up-link") cycles.

The typical base station requires amplification of the RF signals being transmitted by the RF antenna. For this purpose, it has been conventional to use a large linear power amplifier within the control unit at the base of the tower or other support structure. The linear power amplifier must be cascaded into high power circuits to achieve the desired linearity at the higher output power. Typically, for such high power systems or amplifiers, additional high power combiners must be used at the antennas which add cost and complexity to the passive antenna design. The power losses experienced in the RF coaxial cables and through the power splitting at the tower top may necessitate increases in the power amplification to achieve the desired power output at the passive antennas, thereby reducing overall operating efficiency of the base station. It is not uncommon that almost half of the RF power delivered to the passive antennas is lost through the cable and power splitting losses.

More recently, active antennas, such as distributed active antennas, have been incorporated into base station designs to overcome the power loss problems encountered with passive antenna designs. Typical distributed active antennas include one or more sub-arrays or columns of antenna elements with each antenna element having a power amplifier provided at or near the antenna element or associated with each sub-array or column of antenna elements. The array of elements may be utilized to form a beam with a specific beam shape or multiple beams. One example of a distributed active antenna is fully disclosed in U.S. Ser. No. 09/846,790, filed May 1, 2001 and entitled Transmit/Receive Distributed Antenna Systems, which is commonly assigned with the present application and the disclosure of which is hereby incorporated herein by reference in its entirety.

The power amplifiers are provided in the distributed active antenna to eliminate the high amplifying power required in cellular base stations having passive antennas on the tower. By moving the transmit path amplification to the distributed active antennas on the tower, the significant cable losses and splitting losses associated with the passive antenna systems are overcome. Incorporating power amplifiers at the input to each antenna element or sub-array mitigates any losses incurred getting up the tower and therefore improves antenna system efficiency over passive antenna systems.

One problem encountered with distributed active antennas is that if one or more power amplifiers fail on the tower, the antenna elements associated with those failed power amplifiers become non-functional. This results in a loss of radiated power for the distributed active antenna and also a change in the shape of the beam or beams formed by the antenna array. Until the failed power amplifiers are repaired or replaced, the beam forming characteristics of the distributed active antenna are altered or, depending on the extent of the failure, the antenna becomes non-functional.

Therefore, there is a need for a distributed active antenna that is less susceptible to failure of the power amplifiers associated with the antenna elements in the transmit path.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE EMBODIMENTS OF THE INVENTION

Figure 1:
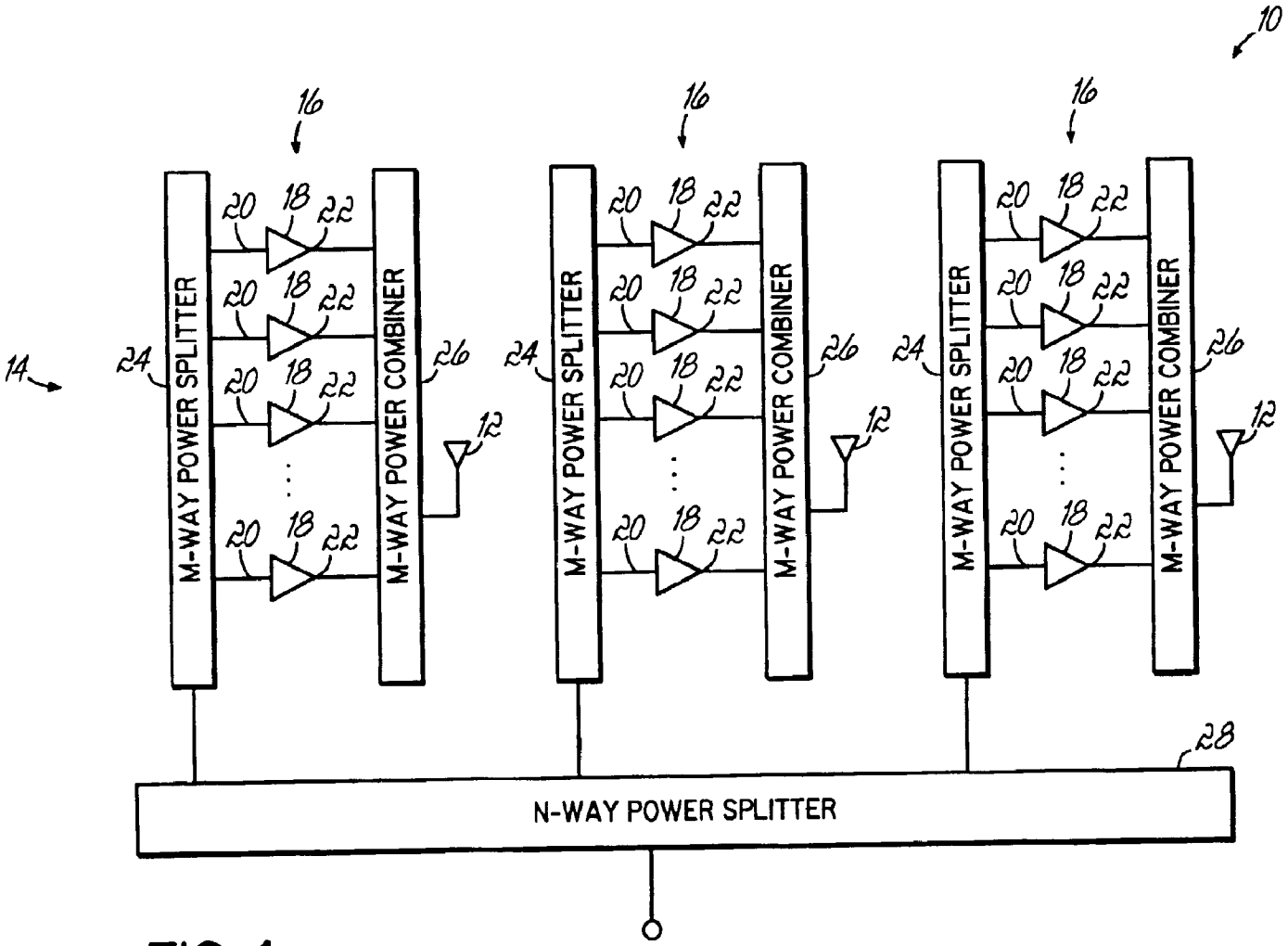
FIG. 1 is a schematic block diagram of a distributed active antenna in accordance with one aspect of the present invention.

Referring now to the Figures, and to FIG. 1 in particular, a distributed active antenna 10 in accordance with one aspect of the present invention is shown. The distributed active antenna 10 comprises a sub-array 14 of N transmit antenna elements 12 that are arranged in either a vertical or horizontal column, although other configurations of the transmit antenna elements 12 are possible as well without departing from the spirit and scope of the present invention. It will be understood that components of the receive antenna elements associated with the distributed active antenna are not shown for purposes of clarity and only the transmit components of the distributed active array are described herein. Those of ordinary skill in the art will readily appreciate the components of the receive antenna elements suitable for use in the distributed active antenna 10 of the present invention.

In this embodiment, each transmit antenna element 12 of the sub-array 14 is coupled to a respective power amplifier module 16 comprising a parallel combination of power amplifiers 18. The number of transmit antenna elements 12 in the sub-array 14 can be scaled to achieve suitable size and antenna directivity.

Each parallel combination of power amplifiers 18 has inputs and combined outputs for driving the respective transmit antenna element 12 associated with each parallel combination of power amplifiers 18. The inputs to each parallel combination of power amplifiers 18 are coupled to an M-way power splitter 24 and the outputs of each parallel combination of power amplifiers 18 are coupled to an M-way power combiner 26. The number of power amplifiers 18 can be scaled to achieve the desired radiated output power for each element 12.

Each transmit antenna element 12 is operatively coupled to one of the respective M-way power combiners 26. The M-way power splitters 24 are coupled to an N-way common power splitter 28. In one embodiment of the present invention, each power amplifier 18 comprises a multicarrier linear power amplifier although other power amplifiers are suitable as well without departing from the spirit and scope of the present invention.

In use of the distributed active antenna 10 during a transmit cycle, an RF signal is applied from the control unit (not shown) of the base station (not shown) to the N-way power splitter 28. The N-way power splitter 28 splits the RF signal N-ways and applies the split RF signals to the M-way power splitters 24. The M-way power splitters 24 associated with each transmit antenna element 12 further split the RF signals M-ways across the inputs of the parallel power amplifiers 18 and apply the split RF signals to the parallel combination of power amplifiers 18 associated with each transmit antenna element 12.

Each power module 16 amplifies the split RF signals with the parallel combination of power amplifiers 18 and the amplified split RF signals are then combined by the M-way power combiner 26 at the outputs of the parallel combination of power amplifiers 18. Each transmit antenna element 12 forms a beam by transmitting the combined amplified RF signal.

The parallel combination of power amplifiers 18 associated with each transmit antenna element 12 provides several advantages. First, the power required to drive each transmit antenna element 12 is less than for a passive antenna design because amplification of the RF signal is performed on the tower at or near each transmit antenna element 12. The reliability of the distributed active antenna 10 is improved because a failure of one or more power amplifiers 18 only decrements the output power by a small amount so the operating performance of the distributed active array 10 is not significantly degraded. In an N antenna element array with M power amplifiers 18 per antenna element, the loss of power in response to a power amplifier failure is approximately given by:

$$\Delta = 10 \cdot \log\left(1 - \frac{\kappa}{N \cdot M}\right)$$

where "k" is the number of amplifier failures. In addition, because the required output power of each power amplifier 18 is low, the power amplifier can be chosen to be small, inexpensive and simple to implement.

Figure 2:
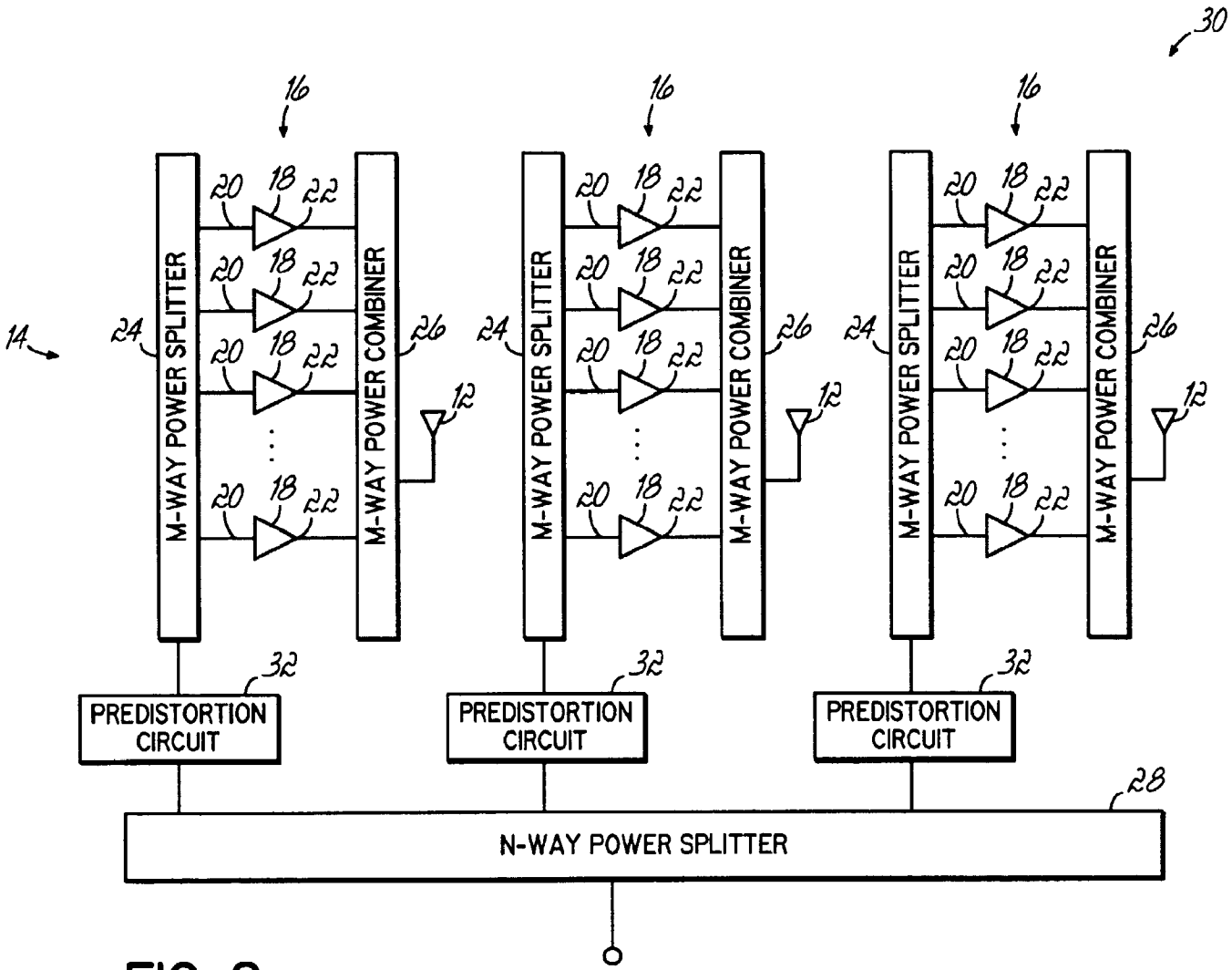
FIG. 2 is a schematic block diagram of a distributed active antenna in accordance with another aspect of the present invention.

FIG. 2 illustrates a distributed active antenna 30 in accordance with another aspect of the present invention and is similar in configuration to the distributed active antenna 10 of FIG. 1, where like numerals represent like parts. In this embodiment, linearization of the signals at the transmit antenna elements 12 is provided by predistortion circuits 32 that are each operatively coupled to the M-way power splitter 24 associated with each transmit antenna element 12. Power amplifiers, such as multi-carrier power amplifiers, generate undesired intermodulation (IM) products in the signal which degrade the signal quality. As will be described in detail below, the predistortion circuits 32 are operable to reduce or eliminate the generation of intermodulation distortion at the outputs of the transmit antenna elements 12 so that a linearized output is achieved.

Figure 3:
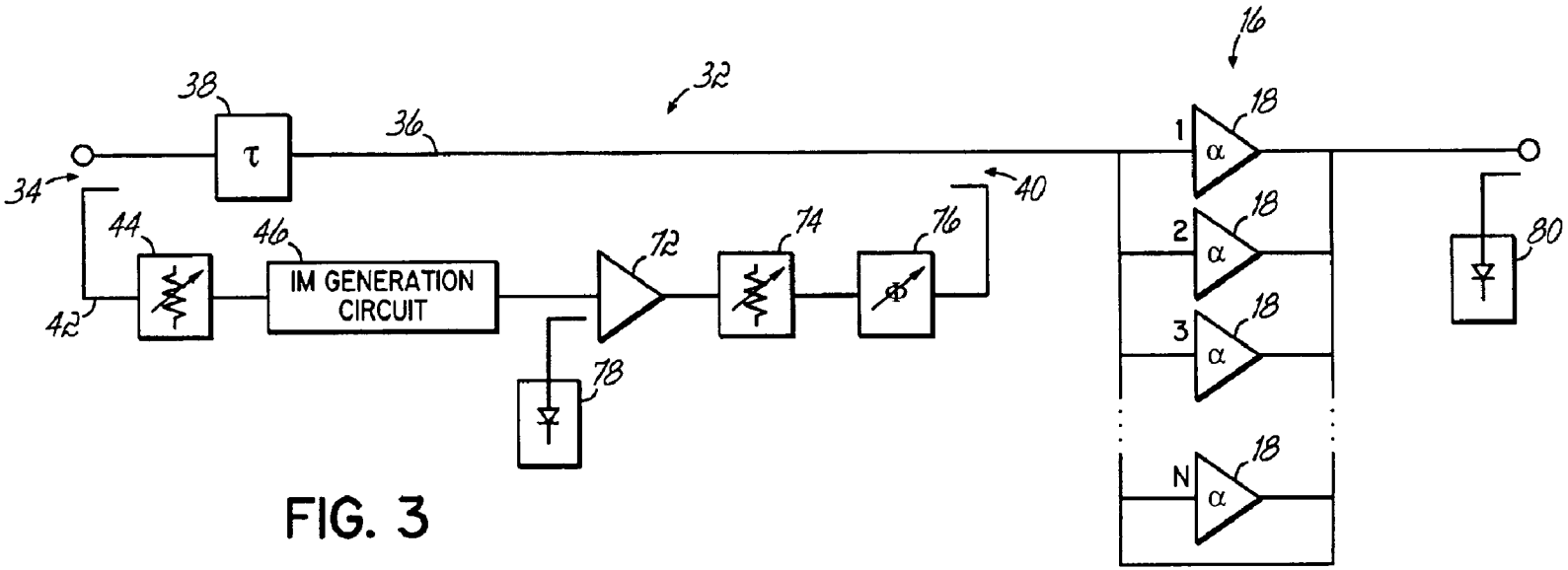
FIG. 3 is a schematic block diagram of a predistortion circuit in accordance with the principles of the present invention for use in the distributed active antenna of FIG. 3.

Referring now to FIG. 3, each predistortion circuit 32 receives an RF carrier signal from the N-way power splitter 28 at an input 34 of the predistortion circuit 32. Along the top path 36, the carrier signal is delayed by a delay circuit 38 between the input 34 and an output 40. Part of the RF carrier signal energy is coupled off at the input 34 for transmission through a bottom intermodulation (IM) generation path 42. An adjustable attenuator 44 is provided at the input of an intermodulation (IM) generation circuit 46 to adjust the level of the coupled RF carrier signal prior to being applied to the intermodulation (IM) generation circuit 46.

Figure 4:
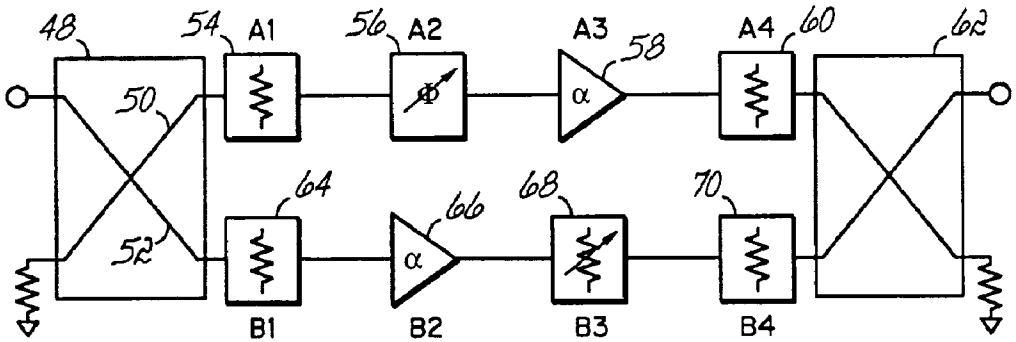
FIG. 4 is a schematic block diagram of an intermodulation generation circuit for use in the predistortion circuit of FIG. 3.

The intermodulation (IM) generation circuit 46 is illustrated in FIG. 4 and includes a 90° hybrid coupler 48 that splits the RF carrier signal into two signals that are applied to an RF carrier signal path 50 and to an intermodulation (IM) generation path 52. In the RF carrier signal path 50, the RF carrier signal is attenuated by fixed attenuator 54 of a sufficient value, such as a 10 dB attenuator, to ensure that no intermodulation products are generated in amplifier 58. The signal is further phase adjusted by variable phase adjuster 56. The attenuated and phase adjusted RF carrier signal is amplified by amplifier 58, but do to the attenuation of the signal, the amplifier 58 does not generate any intermodulation (IM) products at its output so that the output of the amplifier 58 is the RF carrier signal without intermodulation (IM) products. The RF carrier signal in the RF carrier signal path 50 is attenuated by fixed attenuator 60 and applied to a second 90° hybrid coupler 62.

Further referring to FIG. 4, in the intermodulation (IM) generation path 52, the RF carrier signal is slightly attenuated by a fixed attenuator 64, such as a 0–1 dB attenuator, and then applied to an amplifier 66. The amplifier 66 has a similar or essentially the same transfer function as the transfer function of the power amplifiers 18 coupled to the transmit antenna elements 12 and so will generate the similar or essentially the same third, fifth and seventh order intermodulation (IM) products as the power amplifiers 18 used in the final stage of the transmit paths. This insures that characteristics between the IM products of the predistortion circuit are correlated to the amplifier module IM products and characteristics. The amplifier 66 amplifies the RF carrier signal and generates intermodulation (IM) products at its output. The amplified RF carrier signal and intermodulation (IM) product are then applied to a variable gain circuit 68 and a fixed attenuator 70. The phase adjustment of the RF carrier signal by the variable phase adjuster 56 in the RF carrier signal path 50, and the gain of the RF carrier signal and intermodulation (IM) products by the variable gain circuit 68 in the intermodulation (IM) generation path 52, are both adjusted so that the RF carrier signal is removed at the summation of the signals at the second hybrid coupler 62 and only the intermodulation (IM) products remain in the intermodulation (IM) generation path 52.

Referring now back to FIG. 3, the intermodulation (IM) products generated by the intermodulation (IM) generation circuit 46 of FIG. 4 are amplified by amplifier 72 and then applied to a variable gain circuit 74 and variable phase adjuster 76 prior to summation at the output 40. The RF carrier signal in the top path 36 and the intermodulation (IM) products in the intermodulation (IM) generation path 42 are 180° out of phase with each other so that the summation at the output 40 comprises the RF carrier signal and the intermodulation (IM) products 180° out of phase with the RF carrier signal.

The combined RF carrier and intermodulation (IM) products signal is applied to the parallel combination of power amplifiers 18 coupled to each transmit antenna element 12 at the final stages of the transmit paths so that the RF carrier signal is amplified and the intermodulation (IM) products at the output of the power amplifiers 18 are cancelled.

Further referring to FIG. 3, a carrier cancellation detector 78 is provided at the output of the intermodulation (IM) generation circuit 46 to monitor for the presence of the RF carrier signal at the output. If the RF carrier signal is detected, the carrier cancellation detector 78 adjusts the variable phase adjuster 56 and the variable gain circuit 68 of the intermodulation (IM) generation circuit 46 until the RF carrier signal is canceled at the output of the intermodulation (IM) generation circuit 46. An intermodulation (IM) cancellation detector 80 is provided at the output of each parallel combination of power amplifiers 18. If intermodulation (IM) products are detected, the intermodulation (IM) cancellation detector 80 adjusts the variable gain circuit 74 and variable phase adjuster 76 in the bottom intermodulation (IM) generation path 42 until the intermodulation (IM) products are canceled at the outputs of each parallel combination of power amplifiers 18. In this way, the predistortion circuits 32 suppress generation of intermodulation (IM) products by the power amplifiers 18 so that the outputs of the transmit antenna elements 12 are linearized.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, what is claimed is:

1. An active antenna, comprising:

an array of antenna elements;

a power amplifier module coupled to each of the antenna elements of the array;

the power amplifier module comprising a parallel combination of power amplifiers having inputs and combined outputs coupled for driving the respective antenna element of the array;

a power splitter coupled to the inputs of the parallel combination of power amplifiers; and a power combiner coupled to the outputs of the parallel combination of power amplifiers:

wherein the power splitters associated with each parallel combination of power amplifiers are coupled to a common power splitter.

2. The active antenna of claim 1, wherein the power amplifiers comprise multicarrier linear power amplifiers.

3. The active antenna of claim 1, wherein each antenna element is operatively coupled to a respective one of the power combiners.

4. The active antenna of claim 1, further comprising a predistortion circuit operatively coupled to each power amplifier module, the predistortion circuit being operable to suppress intermodulation distortion.

5. The active antenna of claim 4 wherein said predistortion circuit comprises at least one amplifier having a similar transfer function as a transfer function of at least one of the power amplifiers of the power amplifier module.

6. An active antenna, comprising:

an array of antenna elements, wherein the antenna elements are arranged in one or more sub-arrays to define the array;

a power amplifier module coupled to each of the antenna elements of the array;

the power amplifier module comprising a parallel combination of power amplifiers having inputs and combined outputs coupled for driving the respective antenna element of the array;

a power splitter coupled to the inputs of the parallel combination of power amplifiers; and a power combiner coupled to the outputs of the parallel combination of power amplifiers;

wherein the power splitters associated with each parallel combination of power amplifiers are coupled to a common power splitter.

7. The active antenna of claim 6, wherein the power amplifiers comprise multicarrier linear power amplifiers.

8. The active antenna of claim 6, wherein each antenna element is operatively coupled to a respective one of the power combiners.

9. The active antenna of claim 6, further comprising a predistortion circuit operatively coupled to each power amplifier module, the predistortion circuit being operable to suppress intermodulation distortion.

10. The active antenna of claim 9 wherein said predistortion circuit comprises at least one amplifier having similar transfer function as a transfer function of at least one of the power amplifiers of the power amplifier module.

11. An active antenna, comprising:

an antenna element;

a power amplifier module coupled to the antenna element;

the power amplifier module comprising a parallel combination of power amplifiers having inputs and combined outputs coupled for driving the antenna elements;

a power splitter coupled to the inputs of the parallel combination of power amplifiers; and a power combiner coupled to the outputs of the parallel combination of power amplifiers;

wherein the power splitters associated with each parallel combination of power amplifiers are coupled to a common power splitter.

12. The active antenna of claim 11 wherein the amplifiers comprise multicarrier linear power amplifiers.

13. The active antenna of claim 11 further comprising a predistortion circuit operatively coupled to the power amplifier module, the predistortion circuit being operable to suppress intermodulation distortion.

14. The active antenna of claim 13 wherein said predistortion circuit comprises at least one amplifier having a similar transfer function as a transfer function of at least one of the power amplifiers of the power amplifier module.

15. An active antenna comprising:

at least one antenna element;

a power amplifier module coupled to the antenna element;

the power amplifier module comprising a parallel combination of power amplifier, having inputs and combined outputs coupled for driving the antenna element;

a predistortion circuit coupled to the power amplifier module to suppress intermodulation distortion, the predistortion circuit including at least one amplifier having a similar transfer function as a transfer function of at least one amplifier of the power amplifier module.

16. A method of forming a beam at an antenna having a parallel combination of power amplifiers having inputs and combined outputs for driving an antenna element, comprising:

applying an RF signal to a first power splitter and splitting the RF signal with the first power splitter;

applying the split RF signal from the first power splitter to a second power splitter and splitting the split RF signal with the second power splitter:

applying the split RF signal from the second power splitter to the inputs of the parallel combination of power amplifiers;

amplifying the split RF signal with the parallel combination of power amplifier;

combining the amplified split RF signal at the outputs of the parallel combination of power amplifiers; and forming a beam by transmitting the amplified RF signal with the antenna element.

17. The method of claim 16, further comprising the step of:

linearizing the amplified outputs of the parallel combination of power amplifiers.

18. A method of forming beams at an antenna having a parallel combination of power amplifiers having inputs end combined outputs for driving a respective one of a plurality of antenna elements, comprising:

forming a sub-array of the plurality of antenna elements;

applying an RF signal to a first power splitter and splitting the RF signal with the first power splitter;

applying the split RF signal from the first power splitter to a second power splitter and splitting the split RF signal with the second power splitter;

applying the split RF signal from the second power splitter to the inputs of each parallel combination of power amplifiers associated with each of the plurality of antenna elements;

amplifying the split RF signal with the parallel combination of power amplifiers associated with each of the plurality of antenna elements;

combining the amplified split RF signal at the outputs of the parallel combination of power amplifiers; and forming a plurality of beams by transmitting the amplified RF signal with the plurality of antenna elements.

19. The method of claim 18, further comprising the step of:

linearizing the amplified outputs of the parallel combination of power amplifiers associated with each antenna element.

20. An active antenna, comprising:

an array of antenna elements;

a power amplifier module coupled to each of the antenna elements of the array;

the power amplifier module comprising a parallel combination of power amplifiers having inputs and combined outputs coupled for driving the respective antenna element of the array; and a predistortion circuit operatively coupled to each power amplifier module, the predistortion circuit being operable to suppress intermodulation distortion.

21. The active antenna of claim 20 wherein said predistortion circuit comprises at least one amplifier having a similar transfer function as a transfer function of at least one of the power amplifiers of the power amplifier module.

22. An active antenna, comprising:

an array of antenna elements, wherein the antenna elements are arranged in one or more sub-arrays to define the array;

a power amplifier module coupled to each of the antenna elements of the array;

the power amplifier module comprising a parallel combination of power amplifiers having inputs and combined outputs coupled for driving the respective antenna element of the array;

a power splitter coupled to the inputs of the parallel combination of power amplifiers;

a power combiner coupled to the outputs of the parallel combination of power amplifiers; and a predistortion circuit operatively coupled to each power amplifier module, the predistortion circuit being operable to suppress intermodulation distortion.

23. The active antenna of claim 22 wherein said predistortion circuit comprises at least one amplifier having a similar transfer function as a transfer function of at least one of the power amplifiers of the power amplifier module.

24. An active antenna, comprising:

an antenna element;

a power amplifier module coupled to the antenna element;

the power amplifier module comprising a parallel combination of power amplifiers having inputs and combined outputs coupled for driving the antenna element; and a predistortion circuit operatively coupled to the power amplifier module, the predistortion circuit being operable to suppress intermodulation distortion.

25. The active antenna of claim 24 wherein said predistortion circuit comprises at least one amplifier having a similar transfer function as a transfer function of at least one of the power amplifiers of the power amplifier module.

* * * * *

UNITED STATES PATENT AND TRADEMARK OFFICE

CERTIFICATE OF CORRECTION

PATENT NO. : 6,906,681 B2
DATED : June 14, 2005
INVENTOR(S) : Russell Hoppenstein It is certified that error appears in the above-identified patent and that said Letters Patent is hereby corrected as shown below:

Title page,
Item [56], References Cited, U.S. PATENT DOCUMENTS, change "5,815,115 A 8/1998 Cartoni et al. 342/359" to -- 5,815,115 A 9/1998 Carloni et al. 342/359 --.
OTHER PUBLICATIONS, change
"Song, H.J. and Blalkowski, M.E., *Ku-Band*" to
-- Song, H.J. and Bialkowski, M.E., *Ku-Band* --.

Column 6,
Line 8, change "combination of power amplifiers:" to -- combination of power amplifiers; --.
Line 52, change "at least one amplifier having similar transfer function as a transfer function" to -- at least one amplifier having a similar transfer function as a transfer function --.

Column 7,
Line 30, change "signal with the second power splitter:" to -- signal with the second power splitter; --.
Line 35, change "combination of power amplifier;" to -- combination of power amplifiers; --.
Line 45, change "having inputs end combined outputs" to -- having inputs and combined outputs --.

Signed and Sealed this

Twenty-eighth Day of February, 2006

JON W. DUDAS
*Director of the United States Patent and Trademark Office*